US008299385B2

(12) United States Patent
Bae et al.

(10) Patent No.: US 8,299,385 B2
(45) Date of Patent: Oct. 30, 2012

(54) VALVE FOR GAS CIRCUIT BREAKER AND GAS CIRCUIT BREAKER WITH THE SAME

(75) Inventors: Chae Yoon Bae, Chungcheongbuk-Do (KR); Joung Ung Choi, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 169 days.

(21) Appl. No.: 12/879,047

(22) Filed: Sep. 10, 2010

(65) Prior Publication Data

US 2011/0056915 A1 Mar. 10, 2011

(30) Foreign Application Priority Data

Sep. 10, 2009 (KR) ..... 10-2009-0085578

(51) Int. Cl.
*H01H 33/91* (2006.01)

(52) U.S. Cl. ..... 218/66

(58) Field of Classification Search ..... 218/51–66
See application file for complete search history.

(56) References Cited

U.S. PATENT DOCUMENTS 4,239,180 A * 12/1980 Thuries et al. ..... 251/51
4,438,308 A * 3/1984 Korner et al. ..... 218/59
4,459,447 A * 7/1984 Arimoto ..... 218/56
4,611,634 A * 9/1986 Kruckewitt et al. ..... 138/31
4,950,855 A * 8/1990 Bolongeat-Mobleu et al. ..... 218/66
5,126,516 A * 6/1992 Thuries et al. ..... 218/62
5,898,150 A * 4/1999 Gallix et al. ..... 218/66

* cited by examiner

*Primary Examiner* — Truc Nguyen

(74) *Attorney, Agent, or Firm* — Greenblum & Bernstein P.L.C.

(57) ABSTRACT

Disclosed are a valve for a gas circuit breaker, and a gas circuit breaker having the same. The gas circuit breaker comprises a cylinder constituting appearance of the gas circuit breaker, and providing a gas flow path therein, a partition plate having passing holes, and configured to partition inside of the cylinder, a sleeve concentrically disposed in the cylinder, a valve body inserted into the sleeve, and mounted below the partition plate so as to perform a reciprocation along the sleeve, an elastic means configured to upwardly apply an elastic force on a bottom surface of the valve body, and a blocking plate inserted into the sleeve, and mounted between the valve body and the partition plate so as to be moveable in upper and lower directions, wherein the valve body is provided with discharge openings, and the discharge openings are open and closed by movements of the blocking plate.

6 Claims, 2 Drawing Sheets

PRIOR ART

VALVE FOR GAS CIRCUIT BREAKER AND GAS CIRCUIT BREAKER WITH THE SAME

CROSS-REFERENCE TO A RELATED APPLICATION

Pursuant to 35 U.S.C. §119(a), this application claims the benefit of earlier filing date and right of priority to Korean Application 10-2009-0085578, filed on Sep. 10, 2009, the content of which is incorporated by reference herein in its entirety.

BACKGROUND OF THE INVENTION

1. Field of the Invention

The present invention relates to a valve for a gas circuit breaker, and particularly, to a valve for a gas circuit breaker capable of cutting off a current or controlling gas flow in a circuit breaker.

2. Background of the Invention

A circuit breaker indicates a protection device which provides power by being operated as a conductor in an ordinary time, but rapidly cuts off a current when an accident occurs. A gas circuit breaker indicates a circuit breaker using gas as a medium to perform cut off and insulation.

This gas circuit breaker adopts therein a plurality of valves for controlling gas flow. In a case of a serial automatic expansion type circuit breaker, used is a valve configured to allow gas flow when gas has a pressure difference more than a specific value with respect to one direction, and to allow gas flow even when gas has a small pressure difference with respect to another direction. Rapidly operating the valve greatly influences on enhanced performance and reliability of the circuit breaker.

FIGS. 1 and 2 show one example of a valve for a gas circuit breaker. Referring to FIGS. 1 and 2, the valve is installed in a cylinder 10 which forms appearance of the gas circuit breaker and providing a gas flow path therein. A valve fixing bracket 20 is disposed in the cylinder 10, and a sleeve 22 is disposed at a central part of the cylinder 10. The valve consists of a first blocking plate 30 and a second blocking plate 40, and passing holes 32 and 42 are respectively formed at the first blocking plate 30 and the second blocking plate 40 so as not to overlap each other. The valve fixing bracket 20 is disposed between the first and second blocking plates 30 and 40, and is provided with passing holes (not shown) communicated with the passing holes 32 and 42. Accordingly, when both of the first and second blocking plates 30 and 40 are in a closely contacted state to the valve fixing bracket 20, gas flow can not occur. On the other hand, when at least one of the first and second blocking plates 30 and 40 is separated from the valve fixing bracket 20, gas flow can occur.

The first and second blocking plates 30 and 40 are configured to be slidable along a fixing pin 50 in an inserted state to the fixing pin 50. The first blocking plate 30 receives an elastic force which is towards the second blocking plate 40 by a coil spring 52 disposed between the fixing pin 50 and a fixing flange 54. The fixing pin 50 is fixed to the valve fixing bracket 20.

The left side of FIG. 2 illustrates a case that a pressure of 'A' is higher than a pressure of 'B', and the right side of FIG. 2 illustrates an opposite case. If the pressure of 'A' is higher than the pressure of 'B', the second blocking plate 40 moves towards the first blocking plate 30 thus to closely contact the valve fixing bracket 20. The first blocking plate 30 closely contacts the valve fixing bracket 20 by an elastic force of the coil spring 52. Since both of the first and second blocking plates 30 and 40 closely contact the valve fixing bracket 20, gas flow can not occur.

If the pressure is gradually increased to be larger than the elastic force of the spring, the pressure is applied to the first blocking plate 30 through the passing holes 42 of the second shielding late 40. Accordingly, the first blocking plate 30 downwardly moves thus to be separated from the valve fixing bracket 20. As a result, gas inside 'A' is introduced into B'. On the other hand, if the pressure of 'B' is higher than the pressure of 'A', the first blocking plate 30 upwardly moves thus to closely contact the valve fixing bracket 20. Here, the second blocking plate 40 also upwardly moves to open a gas flow path, and gas inside 'B' is introduced into 'A'.

However, the conventional valve for a gas circuit breaker may have the following problems.

The gas flow path is provided through the passing holes arranged at the first and second blocking plates so as to cross each other, thereby limiting an area of the gas flow path. More concretely, if the passing holes formed at one blocking plate are widened, the passing holes formed at another blocking plate have to be narrowed. This may cause a limitation in increasing an area of the gas flow path. As a result, a flow resistance of gas may be increased, and design degrees of freedom may be limited.

SUMMARY OF THE INVENTION

Therefore, an object of the present invention is to provide a gas circuit breaker having a valve capable of reducing a flow resistance by maximizing a flow path area occupied in a valve area.

Another object of the present invention is to provide a valve for a gas circuit breaker capable of reducing a flow resistance by maximizing a flow path area occupied in a valve area.

To achieve these and other advantages and in accordance with the purpose of the present invention, as embodied and broadly described herein, there is provided a gas circuit breaker, comprising: a cylinder constituting appearance of the gas circuit breaker, and providing a gas flow path therein; a partition plate having passing holes, and configured to partition inside of the cylinder; a sleeve concentrically disposed in the cylinder; a valve body inserted into the sleeve, and mounted below the partition plate so as to perform a reciprocation along the sleeve; an elastic means configured to upwardly apply an elastic force on a bottom surface of the valve body; and a blocking plate inserted into the sleeve, and mounted between the valve body and the partition plate so as to be moveable in upper and lower directions, wherein the valve body is provided with discharge openings, and the discharge openings are open and closed by movements of the blocking plate.

The valve body may be formed in a cylindrical shape having one open side surface.

The discharge openings may be arranged on the bottom surface of the valve body in a circumferential direction, and the blocking plate may be formed in a disc shape.

An elastic means fixing flange may be installed at the sleeve, and the elastic means may be disposed between the bottom surface of the valve body and the elastic means fixing flange.

Here, the elastic means may be implemented as a coil spring, and may be insertion-fixed to an outer side of the sleeve.

To achieve these and other advantages and in accordance with the purpose of the present invention, as embodied and broadly described herein, there is also provided a valve for a gas circuit breaker comprising: a cylinder constituting appearance of the gas circuit breaker, and providing a gas flow path therein; a partition plate having passing holes, and configured to partition inside of the cylinder; and a sleeve concentrically disposed in the cylinder, the valve installed at the gas circuit breaker and controlling gas flow, comprising: a valve body inserted into the sleeve, and mounted below the partition plate so as to perform a reciprocation along the sleeve; an elastic means configured to upwardly apply an elastic force on a bottom surface of the valve body; and a blocking plate inserted into the sleeve, and mounted between the valve body and the partition plate so as to be moveable in upper and lower directions, wherein an end of the valve body at a side of the partition plate is open, an end of the valve body at a side of the elastic means is provided with discharge openings, and the discharge openings are open and closed by movements of the blocking plate.

The valve body may be formed in a cylindrical shape having one open side surface.

The discharge openings may be arranged on the bottom surface of the valve body in a circumferential direction, and the blocking plate may be formed in a disc shape.

In the present invention, the gas flow path which enables gas flow may be provided not by two passing holes arranged to cross each other, but by the discharge openings formed on the bottom surface of the valve body. This may simplify the gas flow path thus to reduce a flow resistance. Furthermore, an area of the bottom surface of the valve body which can be utilized as the discharge openings may be increased to enhance design degrees of freedom.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, a preferred embodiment of a valve for a gas circuit breaker according to the present invention will be explained in more detail with reference to the attached drawings.

Figure 1:
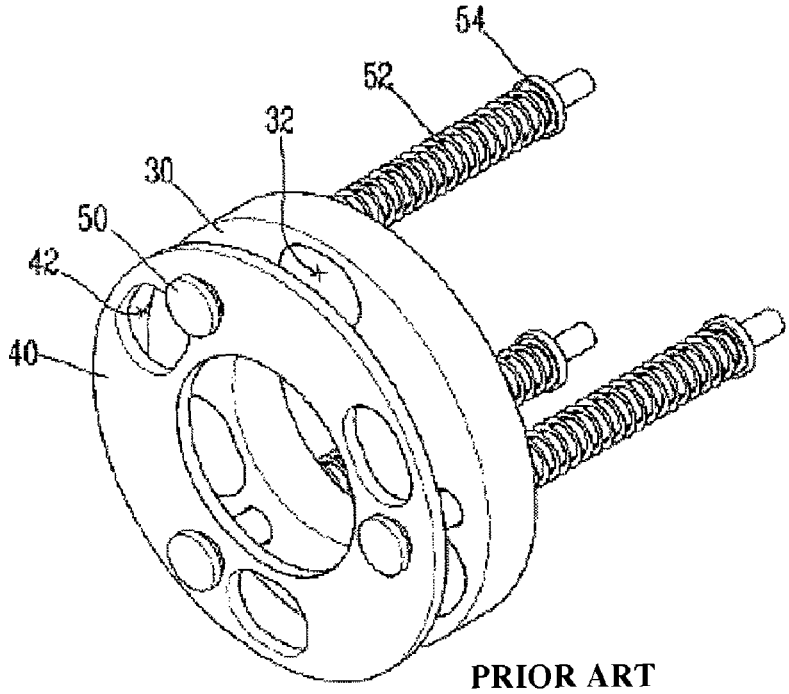
FIG. 1 is a perspective view of a valve for a gas circuit breaker in accordance with the conventional art.
Figure 2:
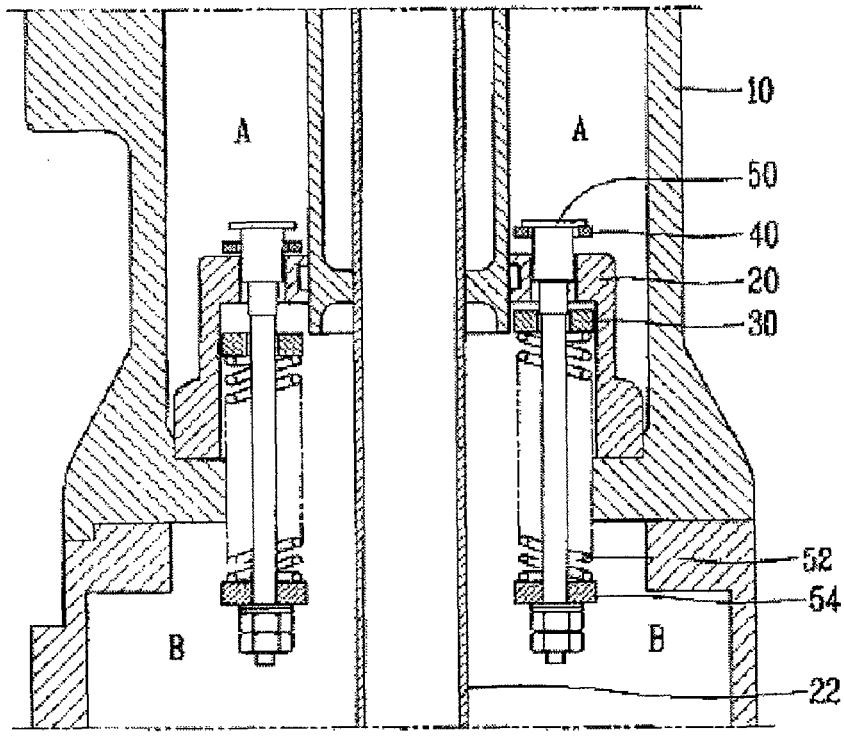
PRIOR ART FIG. 2
FIG. 2 is a sectional view schematically showing one example of a gas circuit breaker to which the valve of FIG. 1 has been applied.
Figure 3:
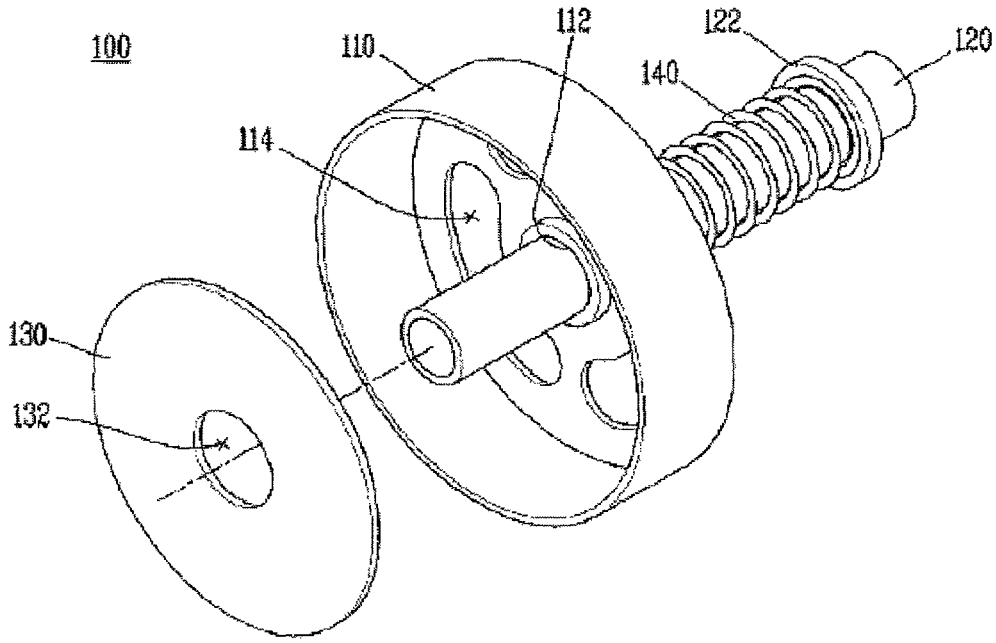
FIG. 3 is a perspective view of a valve for a gas circuit breaker according to a preferred embodiment of the present invention.

FIG. 3 is a perspective view of a valve 100 for a gas circuit breaker according to a preferred embodiment of the present invention.

Referring to FIG. 3, the valve 100 includes a valve body 110 having a hollow type cylindrical shape. One end of the valve body 110 is open, and another end thereof is provided with a sleeve insertion hole 112 for inserting a sleeve 120 to be later explained. Accordingly, the valve body 110 is inserted into the sleeve 120 so as to be moveable along a length direction of the sleeve 120.

Three discharge openings 114 are disposed in a circumferential direction centering around the sleeve insertion hole 112. Each of the discharge openings 114 has a shape of an elongated hole extending along a circular arc.

The sleeve 120 is installed in a gas circuit breaker, and a spring fixing flange 122 is fixedly installed on the surface of the sleeve 120 at a position spacing from a bottom surface of the valve body 110 by a predetermined distance. The spring fixing flange 122 is formed to have a flat disc shape, and a coil spring 140 is disposed between the spring fixing flange 122 and the bottom surface of the valve body 110.

The coil spring 140 is inserted into an outer side of the sleeve 120, and a maximum distance between the valve body 110 and the spring fixing flange 122 is set to be shorter than a length of the coil spring 140. Accordingly, the coil spring 140 is fixed in a compressed state a little. This may allow the coil spring 140 to continuously provide an elastic force to the bottom surface of the valve body 110.

A blocking plate 130 is positioned at an inner side of the valve body 110. To a sleeve insertion hole 132 formed at the center of the blocking plate 130, an outer side of the sleeve 120 is inserted. And, the shielding late 130 is installed so as to be slidable along the sleeve 120 in the same manner as the valve body 110.

Once a pressure is applied to the blocking plate 130, the blocking plate 130 moves along the sleeve 120 towards the valve body 110 thus to closely contact the bottom surface of the valve body 110. Here, an outer diameter of the blocking plate 130 has a size large enough to cover all of the discharge openings 114. Accordingly, once the blocking plate 130 closely contacts the bottom surface of the valve body 110, the discharge openings 114 are closed by the blocking plate 130.

The operation of a gas circuit breaker having the valve will be explained with reference to FIG. 4.

Figure 4:
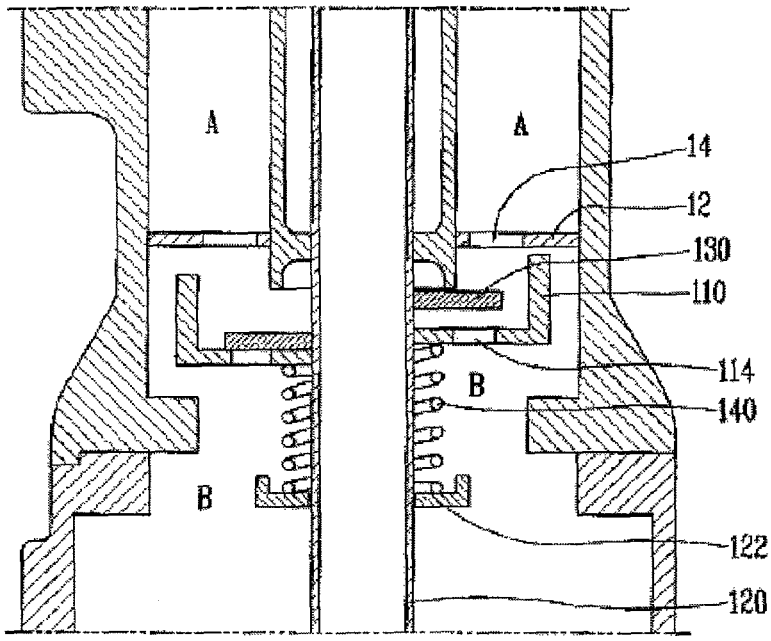
FIG. 4 is a sectional view schematically showing an operation state of a gas circuit breaker to which the valve of FIG. 3 has been applied.

FIG. 4 is a sectional view schematically showing an operation state of a gas circuit breaker to which the valve of FIG. 3 has been applied.

Referring to FIG. 4, the left sectional surface shows a state that a pressure of 'A' is high, whereas the right sectional surface shows a state that a pressure of 'B' is high.

The gas circuit breaker includes a cylinder 10 which constitutes appearance of the gas circuit breaker and provides a gas flow path therein. The sleeve 120 is concentrically arranged in the cylinder 10. A partition plate 12 for partitioning an inner space of the cylinder 10 into two is positioned above the valve body 110, and a plurality of passing holes through which gas flows are formed at the partition plate 12. Hereinafter, an upper space of the partition plate 12 is referred to as 'A', and a lower space of the partition plate 12 is referred to as 'B' for convenience.

An upward movement of the valve body 110 is limited to a predetermined range by the partition plate 12. In a state that an external force has not been applied to the valve body 110, the valve body 110 is upwardly moved so that its open end closely contacts a bottom surface of the partition plate 12.

Referring to the left sectional surface of FIG. 4, a pressure of 'A' is higher than that of 'B'. Accordingly, a downward pressure is applied to the blocking plate 130, and the blocking plate 130 is downwardly moved to closely contact the is bottom surface of the valve body 110. If the pressure of 'A' is increased, the valve body 110 is downwardly moved so that its upper end is separated from the bottom surface of the partition plate 12. Accordingly, gas inside 'A' may be introduced into 'B' via the passing holes 14 of the partition plate 12 and a gap between the partition plate 12 and an upper end of the valve body 110, sequentially.

This gas flow is maintained until a pressure difference of 'A' and 'B' maintains equilibrium with an elastic force of the coil spring 140. If force by the pressure difference of 'A' and 'B' is equal to the elastic force of the coil spring 140, the valve body 110 maintains a contacted state to the bottom surface of the partition plate 12 by the elastic force of the coil spring 140, and the blocking plate 130 maintains a mounted state to the bottom surface of the valve body 110.

Then, if the pressure of 'B' is increased, the pressure is transmitted to the blocking plate 130. Accordingly, as shown in the right sectional surface of FIG. 4, the blocking plate 130 is spaced from the bottom surface of the valve body 110 to form a gas flow path. Through this gas flow path, gas inside 'B' is introduced into 'A' through the discharge openings 114 of the valve body 110 and the passing holes 14 of the partition plate 12.

Under this configuration, a valve assembly installed at the gas circuit breaker serves as a backflow preventing valve configured to allow gas flow only when the pressure of 'A' is higher than the pressure of 'B' by a predetermined value. Furthermore, since the gas flow path is simple, flow resistance may be reduced and the discharge openings may have a small limitation in shape. Besides, since only one spring is used, a limitation of an area of the gas flow path by the spring may be decreased.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A gas circuit breaker, comprising:

a cylinder constituting appearance of the gas circuit breaker, and providing a gas flow path therein;

a partition plate having passing holes, and configured to partition inside of the cylinder;

a sleeve concentrically disposed in the cylinder;

a valve body inserted into the sleeve, and mounted below the partition plate so as to perform a reciprocation along the sleeve;

an elastic means configured to upwardly apply an elastic force on a bottom surface of the valve body; and a blocking plate inserted into the sleeve, and mounted between the valve body and the partition plate so as to be moveable in upper and lower directions, wherein the valve body is provided with discharge openings, and the discharge openings are open and closed by movements of the blocking plate.

2. The gas circuit breaker of claim 1, wherein the valve body is formed in a cylindrical shape having one open side surface.

3. The gas circuit breaker of claim 2, wherein the discharge openings are arranged on the bottom surface of the valve body in a circumferential direction.

4. The gas circuit breaker of claim 3, wherein the blocking plate is formed in a disc shape.

5. The gas circuit breaker of claim 1, wherein an elastic means fixing flange is installed at the sleeve, and the elastic means is disposed between the bottom surface of the valve body and the elastic means fixing flange.

6. The gas circuit breaker of claim 5, wherein the elastic means is implemented as a coil spring, and is inserted into an outer side of the sleeve.

* * * * *